US010283043B2

(12) United States Patent
Lee

(10) Patent No.: US 10,283,043 B2
(45) Date of Patent: May 7, 2019

(54) ORGANIC LIGHT EMITTING DISPLAY DEVICE AND METHOD OF DRIVING THE SAME

(71) Applicant: SAMSUNG DISPLAY CO., LTD., Yongin-si, Gyeonggi-do (KR)

(72) Inventor: Wook Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 168 days.

(21) Appl. No.: 15/215,534

(22) Filed: Jul. 20, 2016

(65) Prior Publication Data

US 2017/0039953 A1 Feb. 9, 2017

(30) Foreign Application Priority Data

Aug. 4, 2015 (KR) ..... 10-2015-0110000

(51) Int. Cl.
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0262* (2013.01); *G09G 2320/0295* (2013.01); *G09G 2320/043* (2013.01); *G09G 2320/0693* (2013.01)

(58) Field of Classification Search
CPC ..... G09G 2320/043; G09G 2320/029; G09G 2320/06
See application file for complete search history.

(56) References Cited

U.S. PATENT DOCUMENTS

| | | | | |
|---|---|---|---|---|
| 8,026,876 | B2 | 9/2011 | Nathan et al. | |
| 2003/0057895 | A1* | 3/2003 | Kimura | G09G 3/3233 315/370 |
| 2010/0225634 | A1* | 9/2010 | Levey | G09G 3/3208 345/212 |
| 2011/0109652 | A1* | 5/2011 | Lee | G09G 3/2092 345/690 |
| 2013/0328841 | A1* | 12/2013 | Syed | G01J 1/0271 345/207 |
| 2014/0313111 | A1* | 10/2014 | Chaji | G09G 3/3225 345/82 |
| 2015/0161942 | A1* | 6/2015 | Chaji | G09G 3/3208 345/78 |

* cited by examiner

*Primary Examiner* — Michael A Faragalla
*Assistant Examiner* — Sujit Shah
(74) *Attorney, Agent, or Firm* — Lewis Roca Rothgerber Christie LLP

(57) ABSTRACT

An organic light emitting display device includes a display panel including a pixel disposed in an intersection of a data line, a feedback line, and a scan line, a data driver sequentially providing reference signals to the pixel though the data line, a sensing unit sequentially generating sensing signals based on voltages applied to the feedback line in response to the reference signals, and a timing controller calculating a compensation coefficient based on the sensing signals and compensating input data based on the compensation coefficient.

17 Claims, 5 Drawing Sheets

ORGANIC LIGHT EMITTING DISPLAY DEVICE AND METHOD OF DRIVING THE SAME

CROSS-REFERENCE TO RELATED APPLICATION

This application claims priority to and the benefit of Korean Patent Application No. 10-2015-0110000, filed on Aug. 4, 2015 in the Korean Intellectual Property Office (KIPO), the content of which is incorporated herein in its entirety by reference.

BACKGROUND

1. Field

Example embodiments of the present invention relate to a display device and a method of driving the same.

2. Description of the Related Art

An organic light emitting display device displays an image using an organic light emitting diode. The organic light emitting diode and/or a driving transistor that transfers a current to the organic light emitting diode may be degraded as the organic light emitting diode (or, the driving transistor) operates. The organic light emitting display device may not display an image with desired luminance due to degradation of the organic light emitting diode and/or degradation of the driving transistor (i.e., referred to as "degradation of a pixel").

A related art organic light emitting display device provides a reference voltage to a pixel, measures a current flowing through the pixel in response to the reference voltage, determines whether or not the pixel is degraded, and compensates the degradation of the pixel based on a current-voltage (I-V) characteristic curve of the pixel, where the current-voltage characteristic curve is previously modeled. However, the current-voltage characteristic curve fails to consider (or, reflect) that an amount of degradation compensation is changed due to a change of a driving condition (e.g., a change of temperature) and operation points (e.g., respective operation points for grayscales in an analog driving technique).

The above information disclosed in this Background section is only for enhancement of understanding of the background of the invention and therefore it may contain information that does not constitute prior art.

SUMMARY

Example embodiments of the present invention relate to an organic light emitting display device and a method of driving the same. For example, according to some example embodiments of the present invention, an organic light emitting display device may be configured to compensate for degradation of pixels.

According to some example embodiments, an organic light emitting display device may be configured to relatively accurately compensate for degradation pixels by reflecting or compensating for changes with respect to one or more driving conditions.

Some example embodiments provide a method of driving the organic light emitting display device.

According to some example embodiments of the present invention, an organic light emitting display device includes: a display panel comprising a pixel at an intersection of a data line, a feedback line, and a scan line; a data driver configured to sequentially provide reference signals to the pixel though the data line; a sensing unit configured to sequentially generate sensing signals based on voltages applied to the feedback line in response to the reference signals; and a timing controller configured to calculate a compensation coefficient based on the sensing signals and to compensate input data based on the compensation coefficient.

According to some embodiments, the compensation coefficient represents a change ratio of current-voltage characteristic of the pixel with respect to a current-voltage characteristic of a reference pixel.

According to some embodiments, the reference signals are included in a linear region comprising an operation voltage of the pixel.

According to some embodiments, the sensing unit is configured to sense a current flowing through an organic light emitting diode of the pixel in response to a first reference signal provided to the pixel and to generate a first sensing signal based on a sensed current.

According to some embodiments, the sensing unit is configured to calculate a current difference between the sensed current and a reference current and to determine the first sensing signal as the current difference.

According to some embodiments, the timing controller is configured to calculate the compensation coefficient during an initial driving phase of the organic light emitting display device.

According to some embodiments, the timing controller is configured to accumulate the input data and to calculate the compensation coefficient when accumulated input data exceeds a reference value.

According to some embodiments, the timing controller comprises a memory configured to store the compensation coefficient.

According to some embodiments, the timing controller is configured to calculate a first compensation coefficient based on a first sensing signal and a second sensing signal that are included in the sensing signals and to compensate the input data based on the first compensation coefficient.

According to some embodiments, the first compensation coefficient is proportional to the first sensing signal and is inversely proportional to the second sensing signal, and the first sensing signal is less than the second sensing signal.

According to some embodiments, the timing controller is configured to select a fourth sensing signal generated based on a first grayscale voltage indicating a first grayscale among the sensing signals and to compensate the first grayscale based on the fourth sensing signal and the first compensation coefficient.

According to some embodiments, the timing controller is configured to calculate an amount of luminance degradation as follows: $\Delta E = Coeff1 * \alpha * \Delta I4 + \beta$, where $\Delta E$ refers to the amount of the luminance degradation, Coeff1 refers to the first compensation coefficient, $\alpha$ refers to a constant, $\Delta I4$ refers to the fourth sensing signal, and $\beta$ refers to a constant.

According to some embodiments, the timing controller is configured to predict a fourth sensing signal that is out of a sensing capacity of the sensing unit by extrapolating the first sensing signal and the second sensing signal and to compensate the input data based on the fourth sensing signal and the first compensation coefficient.

According to some embodiments, the timing controller is configured to: select first through third sensing signals generated based on first through third reference signals among the sensing signals; calculate a first compensation coefficient based on the first sensing signal and the second sensing signal; calculate a second compensation coefficient based on the second sensing signal and the third sensing signal; and select one from the first compensation coefficient and the second compensation coefficient by comparing the first through third reference signals with a fourth reference signal that is equal to a first grayscale voltage indicating a first grayscale.

According to some example embodiments of the present invention, in a method of driving an organic light emitting display device, the method includes: sequentially providing reference signals to a pixel; sequentially generating sensing signals based on voltages applied to a feedback line connected to the pixel in response to the reference signals; calculating a compensation coefficient based on the sensing signals; and compensating input data based on the compensation coefficient.

According to some embodiments, the compensation coefficient comprises a first compensation coefficient calculated based on a first sensing signal and a second sensing signal that are included in the sensing signals.

According to some embodiments, compensating the input data includes: selecting a fourth sensing signal generated based on a fourth reference signal that is the same as a first grayscale voltage indicating a first grayscale among the sensing signals; and compensating the first grayscale based on the fourth sensing signal and the first compensation coefficient.

According to some embodiments, compensating the input data includes: predicting a fourth sensing signal that is out of a sensing capacity of the organic light emitting display device based on the first sensing signal and the second sensing signal; and compensating the input data based on the fourth sensing signal and the first compensation coefficient.

According to some embodiments, calculating the compensation coefficient includes: selecting first through third sensing signals generated based on first through third reference signals among the sensing signals; calculating a first compensation coefficient based on the first sensing signal and the second sensing signals and calculating a second compensation coefficient based on the second sensing signal and the third sensing signals; comparing the first through third reference signals with a fourth reference signal that is equal to a first grayscale voltage indicating a first grayscale; and selecting one from the first compensation coefficient and the second compensation coefficient based on a comparison result.

According to some embodiments, calculating the compensation coefficient includes: selecting a fourth sensing signal generated based on a fourth reference signal that is the same as a first grayscale voltage indicating a first grayscale among the sensing signals; and compensating the first grayscale based on the fourth sensing signal and one selected from the first compensation coefficient and the second compensation coefficient.

Therefore, an organic light emitting display device according to example embodiments of the present invention may be configured to relatively accurately (e.g., exactly) compensate for degradation of one or more pixels by providing reference signals to the pixel(s), by generating sensing signals based on the reference signals, by calculating a compensation coefficient (e.g., a change ratio of a current-voltage characteristic of the pixel with respect to a current-voltage of a reference pixel) based on the sensing signals, and by compensating (e.g., adjusting or modifying) input data based on the compensation coefficient, where the sensing signals include information of a change of a driving condition (e.g., a change of a temperature) at a sensing time (e.g., a time at which the sensing signals are generated).

In addition, a method of driving an organic light emitting display device according to example embodiments may drive the organic light emitting display device effectively.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, aspects of example embodiments of the present invention will be explained in more detail with reference to the accompanying drawings.

Figure 1:
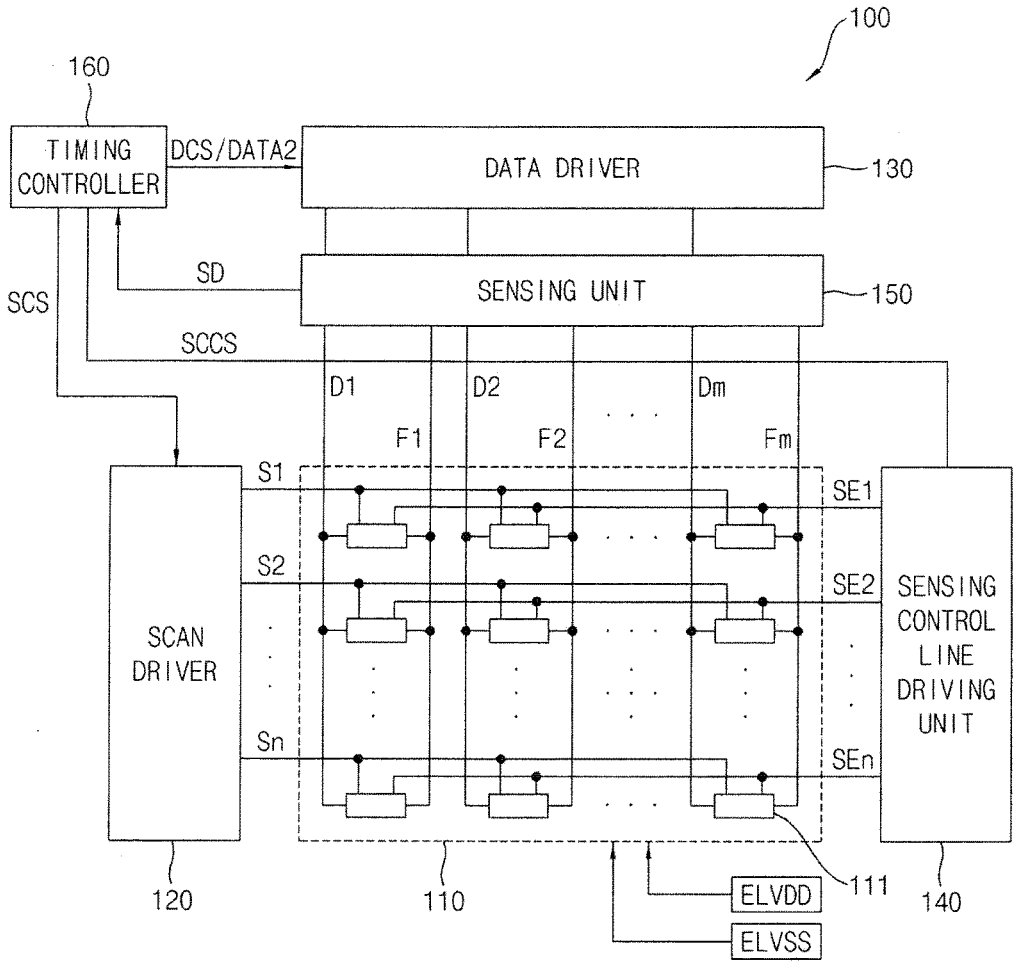
FIG. 1 is a block diagram illustrating an organic light emitting display device according to some example embodiments of the present invention.

FIG. 1 is a block diagram illustrating an organic light emitting display device according to some example embodiments.

Referring to FIG. 1, an organic light emitting display device 100 may include a display panel 110, a scan driver 120, a data driver 130, a sensing control line driving unit 140, a sensing unit 150, and a timing controller 160. The organic light emitting display device 100 may display an image based on image data provided from an outside or external source.

The display panel 110 may include scan lines S1 through Sn, data lines D1 through Dm, sensing control lines SE1 through SEn, feedback lines F1 through Fm, and pixels 111, where each of m and n is an integer greater than or equal to 2. The pixels 111 may be respectively arranged at intersections of the scan lines S1 through Sn, the data lines D1 through Dm, the sensing control lines SE1 through SEn, and the feedback lines F1 through Fm.

Each of the pixels 111 may store a data signal in response to a scan signal, and may emit light based on a stored data signal. A configuration of the pixels 111 will be described in more detail with reference to FIG. 2.

The scan driver 120 may generate the scan signal based on a scan driving control signal SCS. The scan driving control signal SCS may be provided from the timing controller 160 to the scan driver 120. The scan driving control signal SCS may include a start pulse and clock signals, and the scan driver 120 may include a shift register sequentially generating the scan signal based on the start pulse and the clock signals.

The data driver 130 may generate the data signal based on an image data (e.g., a second data DATA2). The data driver 130 may provide the display panel 110 with the data signal generated in response to the data driving control signal DCS. That is, the data driver 130 may provide the data signal to the pixels 111 through the data lines D1 through Dm. The data driving control signal DCS may be provided from the timing controller 160 to the data driver 130.

According to some example embodiments, the data driver 130 may sequentially provide reference signals to the pixels 111 through the data lines D1 through Dm during a sensing period. That is, the data driver 130 may initialize the pixels 111 using the reference signals. Here, the reference signals may be voltages (e.g., that are predetermined or pre-set) to sense a characteristic (e.g., a current-voltage characteristic) of the pixels 111. The reference signals may be voltages close to an operation voltage (e.g., an operation point) of the pixels 111. For example, a current-voltage characteristic curve of an organic light emitting diode included in the pixels 111 may include a linear region (or, a region having a substantially linear gradient), and the reference signals may be a start point of the linear region and an end point of the linear region.

The sensing control line driving unit 140 may generate a sensing control signal in response to a sensing control line driving control signal SCCS. The sensing control line driving control signal SCCS may be provided from the timing controller 160 to the sensing control line driving unit 140.

For a given pixel 111, the sensing unit 150 may sequentially generate sensing signals to generate the current-voltage (I-V) characteristic of the pixel 111 based on the reference signals provided to the pixel 111. For example, the sensing unit 150 may generate a first sensing signal based on a first reference signal and may generate a second sensing signal based on a second reference signal. For example, the sensing unit 150 may sense (e.g., detect or measure) a current flowing through the organic light emitting diode in response to the first reference signal provided to the pixel 111 and may generate the first sensing signal based on a sensed current (e.g., a first sensing current). For example, the sensing unit 150 may calculate a first voltage difference between the sensed current (e.g., the first sensing current) and a first setting voltage (e.g., that is pre-stored or predetermined).

According to some example embodiments of the present invention, the sensing signals may include degradation information of an organic light emitting diode (OLED) included in each of the pixels 111 and threshold voltage/mobility information of a driving transistor. For example, the sensing unit 150 may sense a first sensed current flowing through the organic light emitting diode (OLED), and the degradation information of the organic light emitting diode (OLED) may be calculated based on a variation (or, a change) of the first sensed current (e.g., a current difference between the first sensed current and a first reference current, for example, that is predetermined). For example, the sensing unit 150 may sense a second sensed current flowing through the driving transistor, and the threshold voltage/mobility information of the driving transistor may be calculated based on a variation (or, a change) of the second sensed current (e.g., a current difference between the second sensed current and a second reference current, for example, that is predetermined).

The sensing signals (e.g., a first sensing signal and a second sensing signal) may reflect (or, include) a change of a driving condition at a sensing time point (e.g., a time point at which the sensing signals are generated). For example, the sensing signals may include a variation amount of a current due to a change of a temperature of the organic light emitting display device 100 at the sensing time point. For example, the sensing signals may include a variation amount of a current due to a change of a reference signal (e.g., a change of an operation point of a pixel).

A configuration of the sensing unit 150 will be described in more detail with reference to FIG. 3.

The timing controller 160 may control the scan driver 120, the data driver 130, the sensing control line driving unit 140, and the sensing unit 150. The timing controller 160 may generate the scan driving control signal SCS, the data driving control signal DCS, the sensing control line driving control signal SCCS, and the sensing control signal, and may control the scan driver 120, the data driver 130, the sensing control line driving unit 140, and the sensing unit 150 based on generated signals.

According to some example embodiments, the timing controller 160 may calculate a compensation coefficient to compensate for degradation of a certain pixel (among the pixels 111) based on the sensing signals and may compensate or adjust (e.g., modify) the input data based on the compensation coefficient. Here, the compensation coefficient may represent a change ratio (or, a variation ratio) of a current-voltage characteristic of the certain pixel with respect to (or, based on) a current-voltage characteristic of a reference pixel (e.g., that is pre-set, predetermined, or pre-modeled). According to some example embodiments of the present invention, the compensation coefficient may be a similarity between the current-voltage characteristic of the certain pixel and the current-voltage characteristic of the reference pixel (e.g., that is pre-modeled). For example, in a first area (e.g., an area between a first reference signal and a second reference signal) of a current-voltage characteristic curve of the reference pixel (e.g., that is pre-modeled), a gradient of a current-voltage characteristic curve may be 1, and a gradient of a current-voltage characteristic of the certain pixel may be 0.9. Here, the compensation coefficient may be 0.9 (e.g., 0.9/1). A method of calculating the compensation coefficient will be described in more detail with reference to FIG. 3.

The timing controller 160 may revise (or, update) a compensation data (e.g., a predetermined compensation data) based on the compensation coefficient. The timing controller 160 may compensate for degradation of the organic light emitting diode (OLED) of the pixel and a variation of a threshold/mobility of the driving transistor of the pixel based on the compensation data. The compensation data may be stored in a memory (e.g., provided independently or incorporated into the organic light emitting display device 100).

The timing controller 160 may convert a first data DATA1 into a second data DATA2 based on the compensation data and provide the second data DATA2 to the data driver 130.

The organic light emitting display device 100 may further include a power supplier (or power supply). The power supplier may generate driving voltages to drive the organic light emitting display device 100. The driving voltages may include a first power voltage ELVDD and a second power voltage ELVSS. The first power voltage ELVDD is greater than the second power voltage ELVSS.

As described above, the organic light emitting display device according to example embodiments may sequentially provide reference signals to the pixel 111, may sequentially generate sensing signals to generate a current-voltage characteristic curve of the pixel 111 based on the reference signals, may calculate the compensation coefficient based on the sensing signals, and may compensate or adjust the input data based on the compensation coefficient. The organic light emitting display device 100 may improve accuracy of degradation compensation because the compensation coefficient includes a change (or, a variation) of the current-voltage characteristic of the pixel 111 due to a change of a driving condition of the pixel 111 at a calculating time point (e.g., a time point at which the sensing signals are generated).

Figure 2:
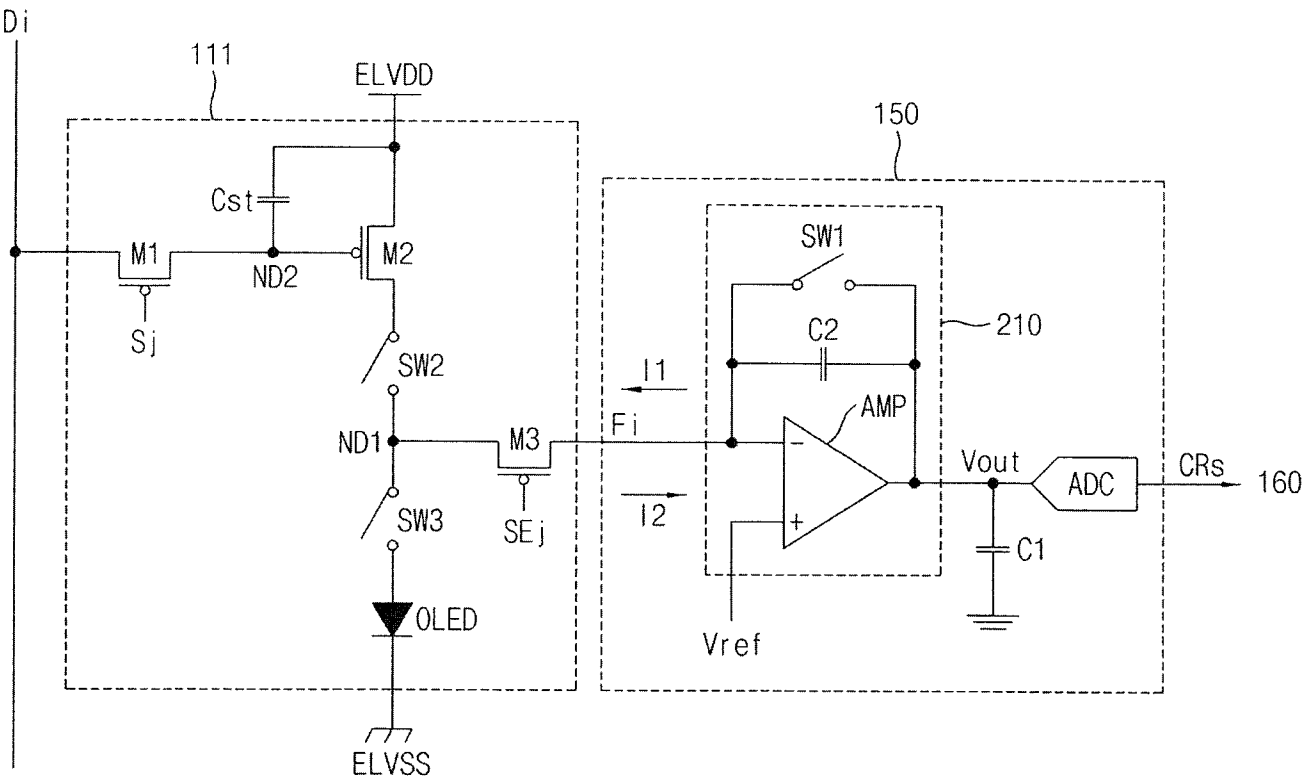
FIG. 2 is a circuit diagram illustrating an example of a pixel and a sensing unit included in the organic light emitting display device of FIG. 1.

FIG. 2 is a circuit diagram illustrating an example of a pixel and a sensing unit included in the organic light emitting display device of FIG. 1.

Referring to FIG. 2, the pixel 111 may include a switching transistor M1, a storage capacitor Cst, a driving transistor M2, an organic light emitting diode OLED, and a sensing transistor M3. The pixel 111 may be electrically connected between an (i)th data line Di and an (i)th feedback line Fi, where i is a positive integer.

The switching transistor M1 may be electrically connected between the (i)th data line Di and a second node ND2 and may be turned on in response to a scan signal Sj. The storage capacitor Cst may be electrically connected between the first power voltage ELVDD and the second node ND2. When the switching transistor M1 is turned on, the storage capacitor Cst may be charged with the data signal provided through the (i)th data line Di. The driving transistor M2 may transfer a driving current to the organic light emitting diode OLED in response to a stored voltage in the storage capacitor Cst.

The organic light emitting diode OLED may be electrically connected between a first node ND1 and the second power voltage ELVSS and may emit light in response to the driving current. The sensing transistor M3 may be electrically connected between the (i)th feedback line Fi and the first node ND1 and may be turned on in response to the sensing control signal SEj.

According to some example embodiments of the present invention, the pixel 111 may further include a second switch SW2 and a third switch SW3. The second switch SW2 may be electrically connected between the driving transistor M2 and the first node ND1 and may be turned off during the first sensing period. Here, the first sensing period may be a period for sensing degradation information of the organic light emitting diode OLED as described above. In the first sensing period, the second switch SW2 may be turned on, the second switch SW3 may be turned on, and the sensing switch SEj may be turned on. Here, a current path is formed between the sensing unit 150 and the second power voltage ELVSS, and a first sensing current I1 may flow through the feedback line Fi (e.g., the first sensing current I1 may flow from the sensing unit 150 through the first node ND1 to the second power voltage ELVSS).

The third switch SW3 may be electrically connected between the first node ND1 and the organic light emitting diode OLED and may be turned off during the second sensing period. In the second sensing period, the second switch SW2 may be turned on, the third switch SW3 may be turned off, and the sensing switch SEj may be turned on. Here, a current path may be formed between the first power voltage ELVDD and the sensing unit 150, and a second sensing current I2 may flow through the feedback line Fi (e.g., the second sensing current I2 may flow from the first power voltage ELVDD through the first node ND1 to the sensing unit 150).

The pixel 111 is illustrated by way of example in FIG. 2. The pixel 111 is not limited thereto.

The sensing unit 150 may include an integrator 210, a convertor ADC, and a memory.

The integrator 210 may integrate a sensing current (e.g., the first sensing current I1 or the second sensing current I2) flowing through the (i)th feedback line Fi according to the reference voltage Vref and may output an output voltage Vout generated by integrating. The integrator 210 may include an amplifier AMP and a second capacitor C2. The amplifier AMP may include a first input terminal electrically connected to the (i)th feedback line Fi, a second terminal receiving the reference voltage Vref, and an output terminal electrically connected to the converter ADC. The second capacitor C2 may be electrically connected between the first input terminal of the amplifier AMP and the output terminal of the amplifier AMP.

The integrator 210 may integrate the first sensing current I1 provided to the pixel 111 through the (i)th feedback line Fi in the first sensing period. Here, the integrator 210 may operate as a current source. The integrator 210 may integrate the second sensing current I2 provided from the pixel 111 through the (i)th feedback line Fi in the second sensing period.

In an example embodiment, the integrator 210 may further include a first switch SW1 that is electrically connected between the first input terminal of the amplifier AMP and the output terminal of the amplifier AMP. The first switch SW1 may be turned on during a reset period. The first switch SW1 may be used to reset (or, initialize) the integrator 210 during the reset period (e.g., the first switch SW1 may be used to discharge a stored voltage of the second capacitor C2 during the reset period).

According to some example embodiments of the present invention, the sensing unit 150 may further include a first capacitor C1 that stores the output voltage Vout of the integrator 210 temporarily. The first capacitor C1 may be electrically connected between the output terminal of the amplifier AMP and a reference signal Vref (e.g., a ground) and may store the output voltage Vout temporarily during the first sensing period or the second sensing period.

The converter ADC may generate sensing data based on the output voltage Vout of the integrator 210. For example, the converter ADC may include a comparator that compares the output voltage Vout of the integrator 210 and a setting voltage (or, the reference voltage Vref).

The sensing unit 150 is illustrated by way of example in FIG. 2. The sensing unit 150 is not limited thereto. For example, the sensing unit 150 may provide a reference current (or, a sensing current) to the pixel 111, may sense a node voltage at the first node ND1, and may generate a sensing data based on the node voltage.

Figure 3:
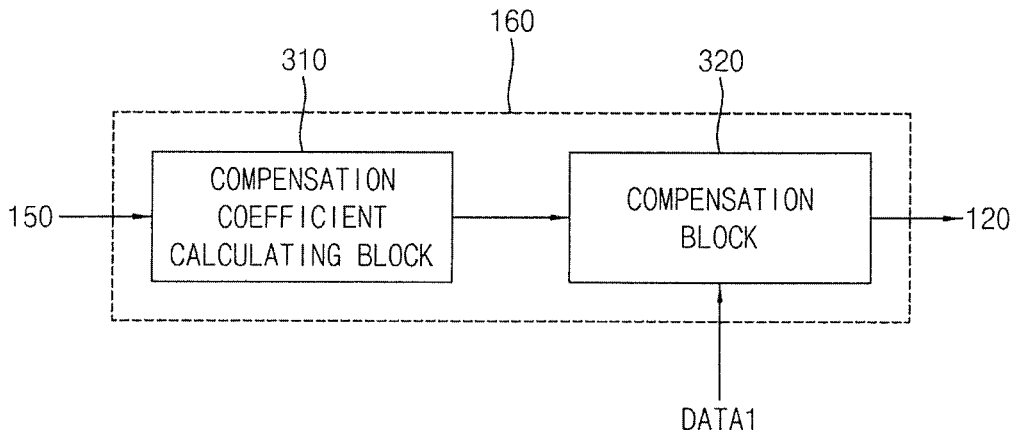
FIG. 3 is a block diagram illustrating an example of a timing controller included in the organic light emitting display device of FIG. 1.
Figure 4:
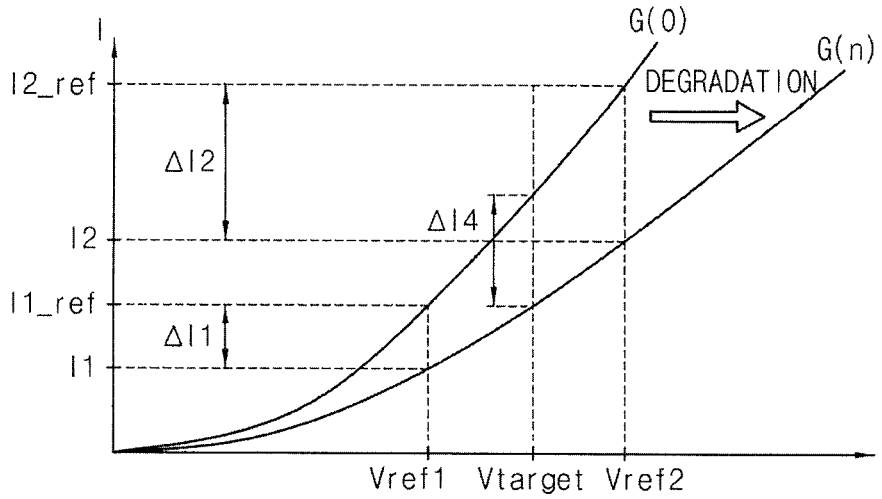
FIG. 4 is a diagram illustrating an example of a current-voltage characteristic curve generated by the timing controller of FIG. 3.

FIG. 3 is a block diagram illustrating an example of a timing controller included in the organic light emitting display device of FIG. 1. FIG. 4 is a diagram illustrating an example of a current-voltage characteristic curve generated by the timing controller of FIG. 3.

Referring to FIGS. 3 and 4, the timing controller 160 may include a compensation coefficient calculating block (or compensation coefficient calculator) 310 and compensation block (or compensator) 320.

The compensation coefficient calculating block 310 may generate a compensation coefficient based on sensing signals provided from the sensing unit 150. For example, the compensation coefficient calculating block 310 may calculate a first compensation coefficient based on a first sensing signal and a second sensing signal.

Referring to FIG. 4, a first curve G(0) may be a characteristic curve of a reference pixel (e.g., that is pre-modeled, or predetermined), and a second curve G(n) may be a characteristic curve of a pixel that is degraded.

As illustrated by the second curve G(n), the first sensing signal (e.g., a first sensing current) generated based on a first reference signal Vref1 may be I1, and the second sensing signal (e.g., a second sensing current) generated based on a second reference signal Vref2 may be I2. Here, the compensation coefficient calculating block 310 may calculate the compensation coefficient based on I1 and I2. The compensation coefficient may be proportional to the first sensing signal and may be inversely proportional to the second sensing signal. Here, the first sensing signal may be less than the second sensing signal. For example, the compensation coefficient calculating block 310 may calculate the compensation coefficient according to Equation 1, below.

$$\text{Coeff}=I1/I2*a \qquad \text{Equation 1}$$

where "Coeff" refers to the compensation coefficient, "I1" refers to the first sensing signal, "I2" refers to the second sensing signal, and "a" refers to a constant.

For example, the compensation coefficient calculating block 310 may calculate the compensation coefficient according to Equation 2 below.

$$\text{Coeff}=(I2-I1)*a \qquad \text{Equation 2}$$

where "Coeff" refers to the compensation coefficient, "I1" refers to the first sensing signal, "I2" refers to the second sensing signal, and "a" refers to a constant.

As described with reference to FIG. 1, the compensation coefficient may represent a change ratio (or, a variation ratio) of a current-voltage (I-V) characteristic of a pixel with respect to a current-voltage (I-V) characteristic of a reference pixel (e.g., that is pre-modeled).

According to some example embodiments of the present invention, the timing controller 160 may further include a memory to store the compensation coefficient. The compensation coefficient calculating block 310 may store (or, update) the compensation coefficient into the memory.

According to some example embodiments of the present invention, the compensation coefficient calculating block 310 may calculate the compensation coefficient at an initial driving phase (or, period) of the organic light emitting display device 100. For example, when power is supplied to the organic light emitting display device 100, the organic light emitting display device 100 may sequentially generate the sensing signals by providing the reference signals to the pixel 111. The compensation coefficient calculating block 310 may calculate the compensation coefficient based on the sensing signals. The compensation coefficient calculating block 310 may revise (or, update) a compensation coefficient (e.g., a predetermined or pre-stored compensation coefficient) in the memory as the compensation coefficient.

In an example embodiment, the compensation coefficient calculating block 310 may calculate the compensation coefficient whenever an event occurs. For example, the compensation coefficient calculating block 310 may accumulate data (e.g., grayscales) for a pixel and may calculate the compensation coefficient for the pixel when an accumulated data exceeds a certain value. For example, the compensation coefficient calculating block 310 may calculate the compensation coefficient with a certain period.

According to some example embodiments of the present invention, the compensation coefficient calculating block 310 may revise (e.g., update or modify) a compensation data (e.g., a predetermined compensation data) based on the compensation coefficient. Here, the compensation data (e.g., the predetermined compensation data) may be configured (e.g., predetermined) to compensate for degradation of an organic light emitting diode (OLED) and a variation of the threshold/mobility of a driving transistor.

The compensation block 320 may compensate (e.g., modify or adjust) input data based on the compensation coefficient. The compensation block 320 may compensate (e.g., modify or adjust) a certain grayscale based on the compensation coefficient and a fourth sensing signal generated based on a fourth reference signal that is the same as or substantially similar to a certain grayscale voltage indicating the certain grayscale. For example, the compensation block 320 may calculate an amount of luminance degradation according to Equation 3, below, and may compensate (e.g., modify or adjust) the certain grayscale based on the compensation data.

$$\Delta E=\text{Coeff}*\alpha*\Delta I4+\beta \qquad \text{Equation 3}$$

where "ΔE" refers to the amount of luminance degradation, "Coeff" refers to the compensation coefficient, "α" refers to a constant, "ΔI4" refers to the fourth sensing signal, and "β" refers to a constant.

Referring again to FIG. 4, the fourth sensing signal generated based on a fourth reference signal that is the same as or substantially similar to a certain grayscale voltage Vtarget indicating the certain grayscale may be ΔI4. That is, the sensing unit 150 may sense (e.g., detect or measure) a sensing current I4 generated based on the certain grayscale voltage Vtarget, may calculate a difference between the sensing current I4 and a current (e.g., a pre-sensed current) I4_ref generated based on the certain grayscale voltage Vtarget, and may determine (or, generates) the fourth sensing signal as the difference.

Therefore, the compensation block 320 may calculate the amount of luminance degradation ΔE based on the fourth sensing signal ΔI4 and the compensation coefficient that is calculated/stored, may obtain the compensation data corresponding to the amount of luminance degradation ΔE from the memory and may compensate a grayscale by adding up (or, summing) the compensation data to the grayscale.

As described with reference to FIGS. 3 and 4, the timing controller 160 may calculate the compensation coefficient based on the sensing signals and may compensate the input data based on the compensation coefficient.

Figure 5:
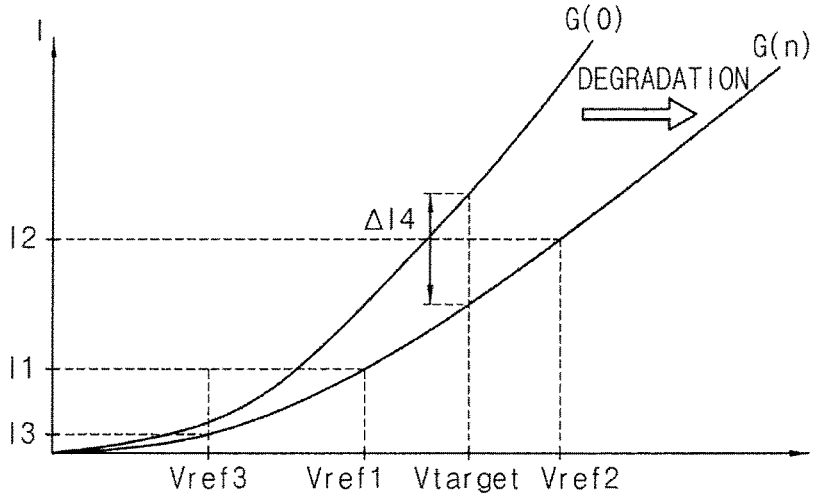
FIG. 5 is a diagram illustrating another example of a current-voltage characteristic curve generated by the timing controller of FIG. 3.

FIG. 5 is a diagram illustrating another example of a current-voltage characteristic curve generated by the timing controller of FIG. 3.

Referring to FIGS. 3 and 5, the timing controller 160 may obtain (or, generate) first through third sensing data I1, I2, and I3 generated based on first through third reference signals Vref1, Vref2, and Vref3, may calculate a first compensation coefficient based on the first sensing signal I1 and the second sensing signal I2, and may calculate a second compensation coefficient based on the second sensing signal I2 and the third sensing signal I3.

For example, the timing controller 160 may calculate the first compensation coefficient based on the first sensing signal I1 generated based on the first reference signal Vref1 (e.g., the first sensing signal I1 measured at a first pixel 111 that provided the first reference signal Vref1) and the second sensing signal I2 generated based on the second reference signal Vref2. In addition, the timing controller 160 may calculate the second compensation coefficient based on the first sensing signal I1 generated based on the first reference signal Vref1 and the third sensing signal I3 generated based on the third reference signal Vref3. Here, the first compensation coefficient and the second compensation coefficient may have different values according to change of the first through third sensing signals I1 through I3.

The timing controller 160 may compensate data for a certain grayscale based on the first compensation coefficient and the second compensation coefficient. The timing controller 160 may compare a fourth reference signal Vtarget of the certain grayscale with the first through third reference signals Vref1 through Vref3 and may select one from the first compensation coefficient and the second compensation coefficient according to a comparison result. As illustrated in FIG. 5, when the fourth reference signal Vtarget is greater than the first reference signal Vref1 and is less than the second reference signal Vref2, the timing controller 150 may select the first compensation coefficient. That is, the timing controller 150 may select one from compensation coefficients based on an operation point (e.g., the fourth reference signal Vtarget).

The timing controller 150 may calculate an amount of luminance degradation ΔE based on a compensation coefficient (e.g., the first compensation coefficient) and a fourth sensing signal ΔI4, may obtain compensation data to compensate for the amount of luminance degradation ΔE, and may compensate a grayscale by adding up (or, summing) the compensation data to the grayscale.

Figure 6:
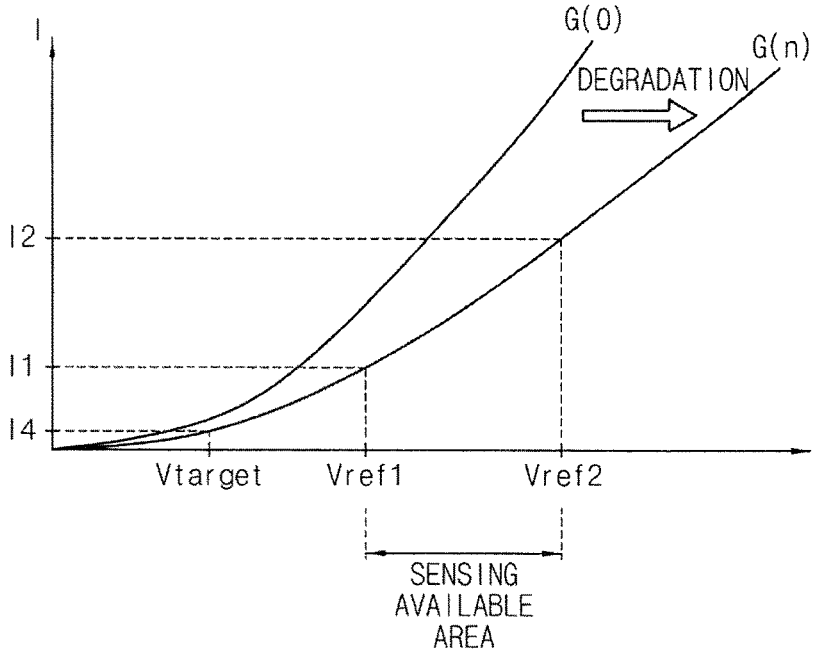
FIG. 6 is a diagram illustrating still another example of a current-voltage characteristic curve generated by the timing controller of FIG. 3.

FIG. 6 is a diagram illustrating still another example of a current-voltage characteristic curve generated by the timing controller of FIG. 3.

Referring to FIGS. 3 and 6, the timing controller 150 may predict a fourth sensing signal I4 generated based on a certain grayscale voltage indicating a certain grayscale based on a first sensing signal I1 and a second sensing signal I2 and may compensate the certain grayscale based on a predicted fourth sensing signal I4 and a compensation coefficient.

For example, when a current sensing available area is corresponding to a voltage area between a first reference signal Vref1 and a second reference signal Vref2, and a fourth reference signal Vtarget of the certain grayscale exceeds the voltage area, the timing controller 160 may predict the fourth sensing signal I4 (e.g., the fourth sensing signal I4 generated based on the fourth reference signal Vtarget) by extrapolating the first sensing signal I1 (e.g., the first sensing signal I1 generated based on the first reference signal Vref1) and the second sensing signal I2 (e.g., the second sensing signal I2 generated based on the second reference signal Vref2) and may compensate (e.g., adjust or modify) the certain grayscale based on a predicted fourth sensing signal I4 and a compensation coefficient.

Because the current sensing available area may be limited according to a read-out device (e.g., an ROIC) that is sensing a current of a pixel, the timing controller 150 may predict the fourth sensing signal I4 using extrapolation when an operation point (e.g., the fourth reference signal Vtarget) of the certain grayscale is out of the current sensing available area.

For example, when the fourth reference signal Vtarget of the grayscale is out of a sensing available area, and the first compensation coefficient and the second compensation coefficient may be present, the timing controller 150 may calculate a third compensation coefficient for the fourth reference signal Vtarget based on the first compensation coefficient and the second compensation coefficient. That is, the timing controller 150 may calculate the third compensation coefficient by extrapolating the first compensation coefficient and the second compensation coefficient. The timing controller 150 may compensate the certain grayscale (e.g., a grayscale corresponding to the fourth reference signal Vtarget) based on a predicted fourth sensing signal I4 and a calculated third compensation coefficient.

As described with reference to FIGS. 5 and 6, the timing controller 150 may predict (or, calculate) a sensing current or a compensation coefficient based on sensing signals pre-measured or compensation coefficients pre-calculated and may compensate the certain grayscale based on a predicted (or, calculated) sensing current or the compensation coefficient. Therefore, the organic light emitting display device 100 may improve an accuracy of degradation compensation for each grayscale.

Figure 7:
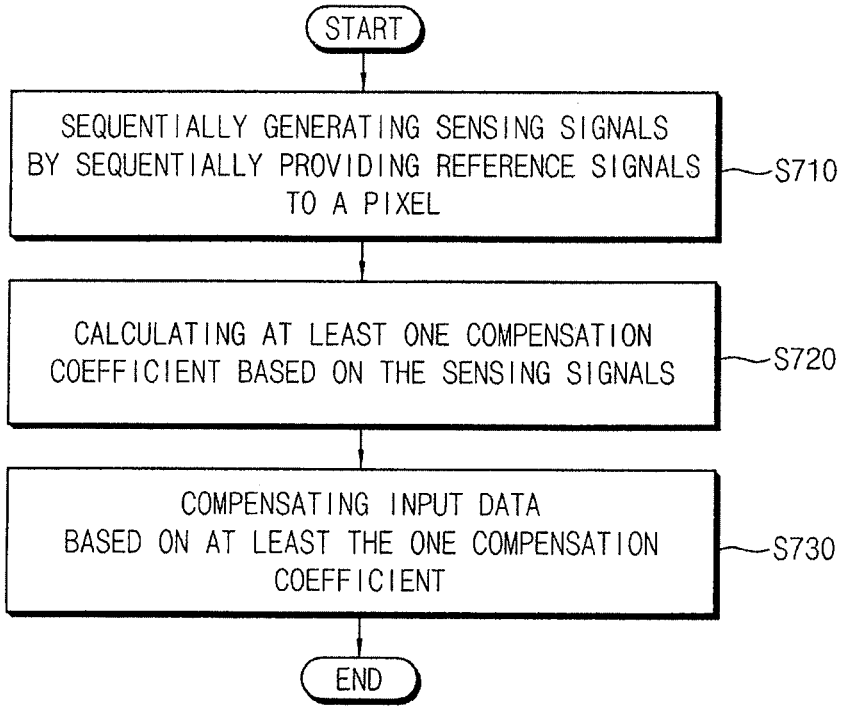
FIG. 7 is a flowchart illustrating a method of driving an organic light emitting display device according to some example embodiments of the present invention.

FIG. 7 is a flowchart illustrating a method of driving an organic light emitting display device according to example embodiments.

Referring to FIGS. 1 and 7, the method of FIG. 7 may include generating (S710) sensing signals by sequentially providing reference signals to a pixel 111. The method of FIG. 7 may include providing the reference signals to the pixel sequentially and generating the sensing signals sequentially based on signals provided to a feedback line (e.g., a feedback line electrically connected to the pixel 111) according to the reference signals. For example, the method of FIG. 7 may include providing a first reference signal Vref1 to the pixel 111 and measuring a signal (e.g., a current or a voltage) provided to the feedback line according to the first reference signal Vref1, and generating a first sensing signal I1 based on a sensed signal. For example, the method of FIG. 7 may include generating a second sensing signal I2 by providing a second reference signal Vref2 to the pixel 111.

The method of FIG. 7 may include calculating (S720) a compensation coefficient based on the sensing signals.

For example, the method of FIG. 7 may include calculating a first compensation coefficient based on the first sensing signal I1 and the second sensing signal I2 that are included in the sensing signals. For example, the method of FIG. 7 may include calculating a second compensation coefficient based on the first sensing signal I1 and the third sensing signal I3 that are included in the sensing signals. Here, the first sensing signal I1 may be less than the second sensing signal I2, and the third sensing signal I3 may be less than the first sensing signal I1.

The method of FIG. 7 may include compensating (e.g., adjusting or modifying) (S730) input data based on the compensation coefficient.

According to some example embodiments of the present invention, the method of FIG. 7 may include obtaining a fourth sensing signal ΔI4 generated based on a certain grayscale voltage indicating a certain grayscale and compensating the certain grayscale based on the fourth sensing signal ΔI4 and the first compensation coefficient.

As described with reference to FIG. 4, the method of FIG. 7 may include sensing (or, detecting, measuring) a sensing current I4 generated based on a certain grayscale voltage Vtarget, calculating a difference between the sensing current I4 and a pre-measured current I4_ref generated based on the certain grayscale Vtarget, and determining (or, generating) the fourth sensing signal ΔI4 as the difference. The method of FIG. 7 may include calculating an amount of luminance degradation ΔE based on the fourth sensing signal ΔI4 and the first coefficient that is pre-calculated/stored, obtaining a compensation data to compensate the amount of luminance degradation ΔE from a memory, and compensating a grayscale by adding up (or, summing) the compensation data to the grayscale.

In an example embodiment, the method of FIG. 7 may include predicting a fourth sensing signal ΔI4 based on the first sensing signal I1 and the second sensing signal I2 and compensating the input data based on the fourth sensing signal I4 and the first compensation coefficient pre-calculated. Here, the fourth sensing signal ΔI4 may be the same as or substantially similar to a certain grayscale voltage Vtarget indicating a certain grayscale, and the fourth sensing signal ΔI4 may not be measured according to a capacity limit of a read-out device (ROIC) that senses a current of the pixel 111 (e.g., the fourth sensing signal ΔI4 may be out of sensing capacity of the organic light emitting display device 100). For example, when capacity of the read-out device (ROIC) is limited, the method of FIG. 7 may include compensating the certain grayscale (e.g., a grayscale of which current is not measured by the read-out device (ROIC)) based on the sensing signals pre-measured and the compensation coefficient (or, the compensation coefficient pre-calculated).

In an example embodiment, the method of FIG. 7 may include calculating compensation coefficients and selecting a certain compensation coefficient among the compensation coefficients. As described with reference to FIG. 5, the method of FIG. 7 may include selecting first through third sensing signals I1 through I3 generated based on first through third reference signals Vref1 through Vref3 among the sensing signals, and calculating a first compensation coefficient and a second compensation coefficient based on the first through third sensing signals I1 through I3. The method of FIG. 7 may include comparing the first through third reference signals Vref1 through Vref3 and a fourth reference signal that is the same as or substantially similar to the certain grayscale voltage indicating the certain grayscale, and selecting a compensation coefficient from the first compensation coefficient and the second compensation coefficient based on a comparison result.

The method of FIG. 7 may include obtaining (e.g., calculating or predicting) the fourth sensing signal ΔI4 and compensating the certain grayscale based on the fourth sensing signal and a selected compensation coefficient (e.g., the first compensation coefficient).

As described above, the method of driving an organic light emitting display device may include providing reference signals to a pixel sequentially, generating sensing signals based on the reference signals sequentially, calculating a compensation coefficient based on the sensing signals, and compensating input data based on the compensation coefficient. Here, the sensing signals may include information of a change (e.g., a temperature change of the organic light emitting display device 100) of driving condition at a sensing time point. Therefore, the method may improve accuracy of compensating for pixel degradation based on the compensation coefficient.

Embodiments of the present invention may be applied to any display device (e.g., an organic light emitting display device, a liquid crystal display device, etc.) including a gate driver. For example, embodiments of the present invention may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments.

Accordingly, all such modifications are intended to be included within the scope of example embodiments as defined in the claims, and their equivalents. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. An organic light emitting display device comprising:

a display panel comprising a pixel at an intersection of a data line, a feedback line, and a scan line;

a data driver configured to sequentially provide reference signals to the pixel though the data line;

a sensing unit configured to sequentially generate sensing signals based on voltages applied to the feedback line in response to the reference signals; and a timing controller configured to calculate a compensation coefficient based on the sensing signals and to compensate input data based on the compensation coefficient, wherein the timing controller is configured to calculate a first compensation coefficient based on a first sensing signal and a second sensing signal that are included in the sensing signals and to compensate the input data based on the first compensation coefficient, and wherein the timing controller is configured to calculate the first compensation coefficient as follows:

Coeff =I1 / I2*a, where "Coeff" refers to the first compensation coefficient, "I1 " refers to the first sensing signal, "I2" refers to the second sensing signal, and "a" refers to a constant, the first sensing signal being a current difference between a sensed current and a reference current.

2. The organic light emitting display device of claim 1, wherein the compensation coefficient represents a change ratio of current-voltage characteristic of the pixel with respect to a current-voltage characteristic of a reference pixel.

3. The organic light emitting display device of claim 1, wherein the reference signals are included in a linear region comprising an operation voltage of the pixel.

4. The organic light emitting display device of claim 1, wherein the sensing unit is configured to sense the sensed current flowing through an organic light emitting diode of the pixel in response to a first reference signal provided to the pixel.

5. The organic light emitting display device of claim 1, wherein the timing controller is configured to calculate the compensation coefficient during an initial driving phase of the organic light emitting display device.

6. The organic light emitting display device of claim 1, wherein the timing controller is configured to accumulate the input data and to calculate the compensation coefficient when accumulated input data exceeds a reference value.

7. The organic light emitting display device of claim 5, wherein the timing controller comprises a memory configured to store the compensation coefficient.

8. The organic light emitting display device of claim 1, wherein the first sensing signal is less than the second sensing signal.

9. The organic light emitting display device of claim 1, wherein the timing controller is configured to select a fourth sensing signal generated based on a first grayscale voltage indicating a first grayscale among the sensing signals and to compensate the first grayscale based on the fourth sensing signal and the first compensation coefficient.

10. The organic light emitting display device of claim 9, wherein the timing controller is configured to calculate an amount of luminance degradation as follows:

$\Delta E = Coeff1 * \alpha * \Delta I4 + \beta$, where $\Delta E$ refers to the amount of the luminance degradation, Coeff1 refers to the first compensation coefficient, $\alpha$ refers to a constant, $\Delta I4$ refers to the fourth sensing signal, and $\beta$ refers to a constant.

11. The organic light emitting display device of claim 1, wherein the timing controller is configured to predict a fourth sensing signal that is out of a sensing capacity of the sensing unit by extrapolating the first sensing signal and the second sensing signal and to compensate the input data based on the fourth sensing signal and the first compensation coefficient.

12. The organic light emitting display device of claim 1, wherein the timing controller is configured to:

select the first sensing signal, the second sensing signal, and a third sensing signal generated based on a first reference signal, a second reference signal, and a third reference signal among the sensing signals;

calculate the first compensation coefficient based on the first sensing signal and the second sensing signal;

calculate a second compensation coefficient based on the second sensing signal and the third sensing signal; and select one from the first compensation coefficient and the second compensation coefficient by comparing the first through third reference signals with a fourth reference signal that is equal to a first grayscale voltage indicating a first grayscale.

13. A method of driving an organic light emitting display device, the method comprising:

sequentially providing reference signals to a pixel;

sequentially generating sensing signals based on voltages applied to a feedback line connected to the pixel in response to the reference signals;

calculating a compensation coefficient based on the sensing signals; and compensating input data based on the compensation coefficient, wherein the compensation coefficient comprises a first compensation coefficient calculated based on a first sensing signal and a second sensing signal that are included in the sensing signals, and wherein the first compensation coefficient is calculated as follows:

$Coeff = I1 / I2 * a$, where "Coeff" refers to the first compensation coefficient, "I1" refers to the first sensing signal, "I2" refers to the second sensing signal, and "a" refers to a constant, the first sensing signal being a current difference between the sensed current and a reference current.

14. The method of claim 13, wherein compensating the input data comprises:

selecting a fourth sensing signal generated based on a fourth reference signal that is the same as a first grayscale voltage indicating a first grayscale among the sensing signals; and compensating the first grayscale based on the fourth sensing signal and the first compensation coefficient.

15. The method of claim 13, wherein compensating the input data comprises:

predicting a fourth sensing signal that is out of a sensing capacity of the organic light emitting display device based on the first sensing signal and the second sensing signal; and compensating the input data based on the fourth sensing signal and the first compensation coefficient.

16. The method of claim 13, wherein calculating the compensation coefficient comprises:

selecting the first sensing signal, the second sensing signal, and through a third sensing signals generated based on first through third reference signals among the sensing signals;

calculating the first compensation coefficient based on the first sensing signal and the second sensing signal and calculating a second compensation coefficient based on the second sensing signal and the third sensing signals;

comparing the first through third reference signals with a fourth reference signal that is equal to a first grayscale voltage indicating a first grayscale; and selecting one from the first compensation coefficient and the second compensation coefficient based on a comparison result.

17. The method of claim 16, wherein calculating the compensation coefficient comprises:

selecting a fourth sensing signal generated based on a fourth reference signal that is the same as a first grayscale voltage indicating a first grayscale among the sensing signals; and compensating the first grayscale based on the fourth sensing signal and one selected from the first compensation coefficient and the second compensation coefficient.

* * * * *